US007677548B2

(12) United States Patent
Chino

(10) Patent No.: US 7,677,548 B2
(45) Date of Patent: Mar. 16, 2010

(54) CASSETTE AND IMAGE FORMING APPARATUS WITH MULTIPLE SEPARATION PORTIONS

(75) Inventor: Hiroki Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/126,563

(22) Filed: May 23, 2008

(65) Prior Publication Data

US 2008/0296827 A1 Dec. 4, 2008

(30) Foreign Application Priority Data

May 30, 2007 (JP) ..... 2007-143664

(51) Int. Cl.
*B65H 5/26* (2006.01)

(52) U.S. Cl. ..... 271/9.11; 271/162; 271/164

(58) Field of Classification Search ..... 271/9.11, 271/162, 164
See application file for complete search history.

(56) References Cited

U.S. PATENT DOCUMENTS 6,776,405 B2 * 8/2004 Eskey ..... 271/9.08

FOREIGN PATENT DOCUMENTS

JP 2000-233836 8/2000
JP 2001-301994 10/2001
JP 2002-321838 11/2002
JP 2004-035220 2/2004
JP 2006-176305 7/2006
JP 2006176305 A * 7/2006
JP 2007-106560 4/2007
JP 2007181933 A * 7/2007

* cited by examiner

*Primary Examiner*—Patrick H Mackey
*Assistant Examiner*—Gerald W McClain
(74) *Attorney, Agent, or Firm*—Workman Nydegger

(57) ABSTRACT

A cassette for mounting on an image forming apparatus body and supplying media to the apparatus body. The cassette includes a first tray, a second tray and a slide mechanism. The first tray and second tray are each able to contain multiple media. The slide mechanism allows the trays to be movable relative to each other. The first tray has an oblique surface and a first separation portion, and the second tray has an oblique surface and a second separation portion. Each of the oblique surfaces can separate an uppermost medium from other media such that distal ends of the media during delivery abut against the oblique surface. Each of the first and second separation portions guides the separated medium along the oblique surface in a paper feeding direction. The first separation portion has a different structure than the second separation portion provided for the second tray.

7 Claims, 10 Drawing Sheets

CASSETTE AND IMAGE FORMING APPARATUS WITH MULTIPLE SEPARATION PORTIONS

BACKGROUND

1. Technical Field

The present invention relates to a cassette that has a tray, which contain medium, such as sheets of paper, and that is mounted on an image forming apparatus in order to supply the media and an image forming apparatus that is provided with the cassette.

2. Related Art

In an existing art, a cassette-type paper feeding system in which a cassette that loads and contains sheets of paper as media is mounted on a printer body to feed paper is known as a paper feeding system of a printer, which is an image forming apparatus of this type. The cassette contains one type of sheet of paper. When the paper size is changed, the cassette needs to be manually replaced. In addition, there is known a feeding system that is provided with a divider for each paper size in the tray of a cassette in order to be able to support multiple types of paper size, which is, for example, described in JP-A-2002-321838.

The printer body is provided with a pick-up roller so that the pick-up roller is arranged to be contactable on the upper face of sheets of paper loaded on the cassette in a state where the cassette is mounted, and an uppermost sheet of paper is delivered from the cassette in such a manner that the pick-up roller is driven for rotation. At this time, multiple sheets of paper may possibly be delivered in a state where lower side sheets of paper overlap the uppermost sheet of paper; however, the distal ends of the sheets of paper abut against the oblique surface of a separation plate (separation portion) that extends from the downstream end in the paper feeding direction of the cassette, so that only the uppermost sheet of paper is separated from the lower side sheets of paper and the separated sheet of paper is guided along the oblique surface of the separation portion to thereby be delivered, for example, upward, which is, for example, described in JP-A-2002-321838.

Incidentally, it is conceivable that a cassette structure is provided so that a plurality of trays are provided multiply in a cassette so as to be capable of containing multiple types of sheets of paper having different paper types or sizes. In this case, it is conceivable that sheets of paper that are delivered from an upper tray is separated by having it abut against the oblique surface of the separation plate that extends from the end of a lower tray and, in this manner, the separation plate is shared between the trays. However, the type and/or size of a sheet of paper loaded on each tray is different from each other. For example, if the tray is an A4 size tray, "plain paper" is normally used. On the other hand, if the tray is a tray that contains a small size sheet of paper of which the paper size is about L size or 2L size, "photo paper" or "postcard" is normally used.

If the sheet of paper is thin and flexible like "plain paper", it is apt to bend. Thus, if the sheet of paper can be separated so that the distal end of the sheet of paper abuts against the oblique surface of the separation portion, even when the angle of inclination of the oblique surface is somewhat large, the sheet of paper may be guided in a substantially vertical direction. However, when the angle of the oblique surface is relatively small, the sheet of paper cannot be separated. In this case, a lower side sheets of paper together with the uppermost sheet of paper is also delivered. This leads to a multi feeding error that multiple sheets of paper are fed. In the meantime, in the case of a hard sheet of paper, such as "photo paper" or "postcard", when the distal end of the sheet of paper abuts against the oblique surface of the separation portion, it is possible to be separated even when the angle of the oblique surface is somewhat large; however, because the sheet of paper is not easy to bend, it is difficult to guide the sheet of paper along the large-angled oblique surface in a substantially vertical direction. In this case, this leads to a paper feeding error that the sheet of paper is not delivered. Therefore, in the cassette that has multiple trays, when the separation portion is shared among the trays, there has been a possibility that inconvenience that separation of sheets of paper or guiding of the separated sheet of paper in a paper feeding direction is not appropriately performed in each tray may occur.

SUMMARY

An advantage of some aspects of the invention is that it provides a cassette that is able to effectively reduce a feeding error of a medium by further reliably performing separation of the medium and guiding the separated medium in a feeding direction even when the medium is delivered from any tray in the cassette provided with a plurality of trays and also provides an image forming apparatus.

An aspect of the invention provides a cassette. The cassette is used by being mounted on an image forming apparatus body and can be accommodated in a state where media, which will be supplied to the image forming apparatus body, are loaded. The cassette includes a first tray, a second tray and a slide mechanism. The first tray is able to contain multiple media. The second tray is able to contain multiple media. The slide mechanism allows the first tray and the second tray to be movable relative to each other. The first tray has an oblique surface and a first separation portion, and the second tray has an oblique surface and a second separation portion. Each of the oblique surfaces can separate an uppermost medium from other media in such a manner that distal ends of the media during delivery abut against the oblique surface. Each of the first and second separation portions guides the separated medium along the oblique surface in a paper feeding direction. The first separation portion provided for the first tray is different in structure of the oblique surface from the second separation portion provided for the second tray. Note that the aspect of the invention does not limit the number of trays to two, that is, the first tray and the second tray, but it may include the configuration of a cassette that is provided with three or more trays as far as the first tray and the second tray are included.

According to the above aspect, because, when media loaded on the first tray are fed, the distal ends of the media being delivered abut against the oblique surface of the first separation portion that has the appropriate oblique surface structure in conformity with the media contained in the first tray, an uppermost medium may be reliably separated and the separated medium may be guided along the oblique surface in the delivery direction. In addition, because, when media loaded on the second tray are fed, the distal ends of the media being delivered abut against the oblique surface of the second separation portion that has the appropriate oblique surface structure in conformity with the media contained in the second tray, an uppermost medium may be reliably separated and the separated medium may be guided along the oblique surface in the delivery direction. Thus, in the cassette that is provided with the plurality of trays, even when the trays contain different medium sizes or medium qualities of media, when media are delivered from the tray, separation of an uppermost medium and guiding of the separated medium in the delivery direction are further reliably performed even when media are fed from any tray, so that it is possible to effectively reduce a delivery error of a medium.

In the cassette according to the aspect of the invention, the oblique surface of the first separation portion and the oblique surface of the second separation portion may have different angles of inclination. According to the above aspect, because the oblique surface of the first separation portion and the oblique surface of the second separation portion are formed to have different angles of inclination in conformity with media that are separated and guided, even when the medium size or medium quality is different among the trays, it is possible to effectively reduce an delivery error of a medium.

In the cassette according to the aspect of the invention, the oblique surface of the first separation portion and the oblique surface of the second separation portion may have different coefficients of friction. According to the above aspect, because the oblique surface of the first separation portion and the oblique surface of the second separation portion are formed to have different coefficients of friction in conformity with media that are separated and guided, even when the medium size or medium quality is different among the trays, it is possible to effectively reduce an delivery error of a medium.

In the cassette according to the aspect of the invention, the second tray may be a small-sized tray of which the size of a containable medium is smaller that that of the first tray, wherein an angle of inclination of the oblique surface of the second separation portion may be set smaller than an angle of inclination of the oblique surface of the first separation portion.

Here, a small-sized medium (a photo paper, a postcard, or the like, of L size, 2L size, or the like) generally tends to be thick as compared with a large-sized medium (a plain paper of A4 size, or the like). Then, in the case of a thick medium, it is easily separated even when the angle of inclination of the oblique surface of the separation portion is relatively small; however, because the medium is thick, it is not easy to bend and it is relatively difficult to guide it along the oblique surface in the delivery direction. On the other hand, in the case of a thin medium, even when the angle of inclination is somewhat large, the medium is bent and guided along the oblique surface in the delivery direction; however, because the medium is thin, adherence between adjacent media is high and, therefore, it is relatively difficult to separate an uppermost medium from lower side media. According to the aspect of the invention, because the angle of inclination of the second separation portion on the second tray side that contains small-sized media and that highly frequently contains thick media is made small, small-sized media contained in the second tray may be appropriately separated and guided during delivery of the media and, in addition, large-sized media contained in the first tray may be appropriately separated and guided during delivery of the media.

In the cassette according to the aspect of the invention, the second tray may be a tray that contains media that are harder than media contained in the first tray, wherein an angle of inclination of the oblique surface of the second separation portion may be set smaller than an angle of inclination of the oblique surface of the first separation portion. Incidentally, the hard media means that the material of media is hard or that the media become hard because media are thick. In addition, "hard" means a property that it is hard to bend when a force is applied continuously in the bending direction or a property that a force that is required to bend by a certain amount in the bending direction is large.

According to the above aspect, because the media are hard when the media are delivered from the second tray, even when the angle of inclination is relatively small, when the distal ends of the media abut against the oblique surface of the second separation portion, the uppermost medium is reliably separated from the lower side media. Then, the separated uppermost medium itself is hard and is not easy to bend; however, because the medium is guided along the oblique surface of which the angle of inclination is small, the medium is reliably delivered in the delivery direction. On the other hand, when the media are delivered from the first tray, even when the media are soft (not hard) and have high adherence, because the distal ends of the media abut against the oblique surface of the first separation portion of which the angle of inclination is large, the media are reliably separated. Then, the separated uppermost medium, even when the angle of inclination is large, bends and is reliably guided along the oblique surface in the delivery direction.

In the cassette according to the aspect of the invention, the cassette may further include a power transmission mechanism that contacts or leaves a power output portion provided for the image forming apparatus body in accordance with insertion or removal of the cassette to or from the image forming apparatus body, wherein the power transmission mechanism, when the cassette is mounted, may move the first tray and the second tray relative to each other by power input from the power output portion.

According to the above aspect, as the cassette is inserted (mounted) in the image forming apparatus body, the power transmission mechanism on the cassette side is connected to the power output portion on the image forming apparatus body side so that they can transmit power. Then, the power from the power output portion is input to the power transmission mechanism, so that the first tray and the second tray move relative to each other. Because it is configured to use the power from the image forming apparatus body side, it is not necessary to provide a power source, or the like, on the cassette side, and the cassette may only have a simple configuration.

In the cassette according to the aspect of the invention, the power output portion may include a driving gear and a power source that outputs power that drives the driving gear for rotation, wherein the power transmission mechanism may be provided for one of the first tray and the second tray and may include a pinion that is engaged with the driving gear when the cassette is mounted and a rack that is provided for the other one of the first tray and the second tray and is engaged with the pinion.

According to the above aspect, as the cassette is mounted on the image forming apparatus body, the pinion and the driving gear are engaged with each other. Through this engagement, power from the power source is input as a rotary force of the pinion and the rack that is engaged with the pinion moves, so that the first tray and the second tray move relative to each other. Because the power transmission mechanism on the cassette side has a rack and pinion mechanism, it is possible to simplify the power transmission mechanism for moving the first tray and the second tray relative to each other.

Another aspect of the invention provides an image forming apparatus. The image forming apparatus includes the cassette according to the above aspect of the invention and an image forming apparatus body that has a mounting portion on which the cassette can be mounted. According to the above aspect, because the cassette according to the above aspect of the invention is provided, the same function and advantageous effects as those of the cassette according to the above aspect of the invention may be obtained.

In the image forming apparatus according to the aspect of the invention, the image forming apparatus body may include a pick-up roller that is driven so as to be able to deliver media on the cassette that is mounted on the mounting portion, wherein the first tray and the second tray, when the cassette is mounted, may be movable relative to each other between a first position at which the pick-up roller contacts an uppermost medium among media loaded on the first tray and a second position at which the pick-up roller contacts an uppermost medium among media loaded on the second tray, wherein a tray from which the pick-up roller delivers media may be switched in such a manner that a relative position between the first tray and the second tray is switched between the first position and the second position.

According to the above aspect, the tray from which the pick-up roller delivers media is switched in such a manner that the relative position between the first tray and the second tray are switched between the first position and the second position. Thus, multiple types of media may be fed using one cassette and, even when any media are fed among the multiple types of media, it is possible to appropriately separate the media and appropriately guide the separated media using the separation portions of which the angles of inclination are different and which are respectively provided for the trays.

In the image forming apparatus according to the aspect of the invention, the cassette may be configured to include the power transmission mechanism, wherein the image forming apparatus body may further include a power output portion that, when the cassette is mounted, can be connected to the power transmission mechanism so as to be able to transmit power, and wherein a relative position between the first tray and the second tray may be switched between the first position and the second position by power input from the power output portion to the power transmission mechanism.

According to the above aspect, using the power from the power output portion on the image forming apparatus body side, switching of the relative position between the first tray and the second tray in the cassette is performed. Thus, switching of the tray that delivers media may be performed not by manual operation but by automatic operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
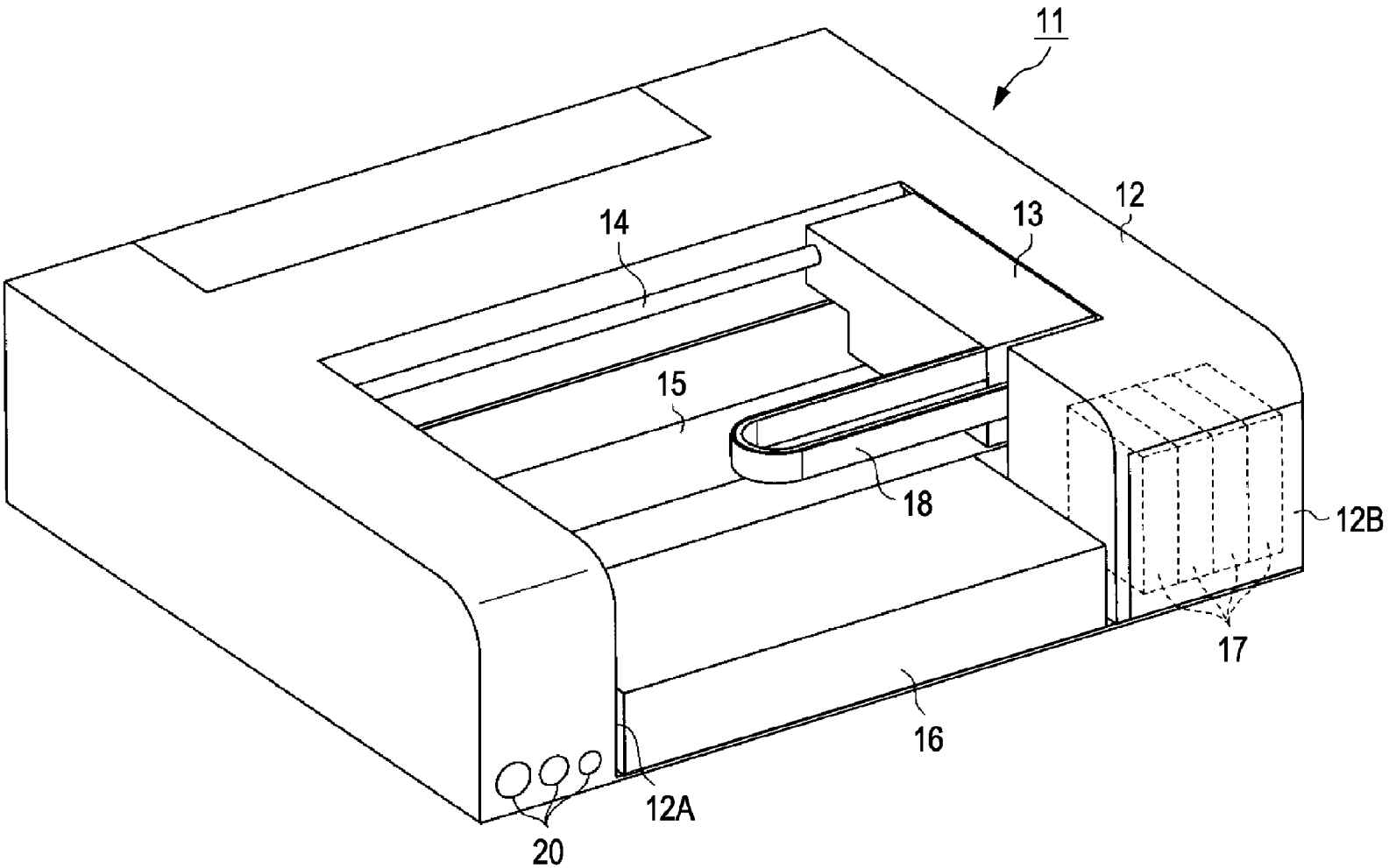
FIG. 1 is a perspective view of a printer according to an embodiment.

Hereinafter, an embodiment of the invention will be described with reference to FIG. 1 to FIG. 10. FIG. 1 is a perspective view that shows a printer, which serves as an image forming apparatus, according to the present embodiment. As shown in FIG. 1, the printer 11 has a rectangular box-shaped main body 12. Around the center of the main body 12, a carriage 13 is provided so as to move reciprocally in a main scanning direction in such a manner that the carriage 13 is guided by a guide shaft 14 that is provided so as to extend in a lateral direction (main scanning direction) in FIG. 1.

As shown in FIG. 1, around the center of the main body 12, a long plate-like platen 15 is arranged at a lower position that faces the carriage 13 so that the longitudinal direction of the platen 15 is parallel to the main scanning direction. At the front face (the face facing toward the front in FIG. 1) and lower portion of the printer 11, a paper feeding cassette 16 is mounted (inserted) in a recessed mounting portion 12A, which is formed in the main body 12 so that the front side is open, in a state where it may be inserted or removed. In addition, a cover 12B covers the right end front face of the main body 12 and a plurality of ink cartridges 17 are loaded inside the cover 12B. Inks of the ink cartridges 17 are respectively supplied to the carriage 13 through a plurality of ink supply tubes (not shown) provided for a flexible wiring substrate 18, and then ink droplets are ejected (discharged) from a print head 19 (shown in FIG. 2) that is provided at the lower portion of the carriage 13. Note that the print head 19 is internally provided with a pressurizing element (piezoelectric element, electrostatic element, heater element, or the like), which applies an ink with pressure for ejecting the ink, in each nozzle. When a predetermined voltage is applied to the pressurizing element, ink droplets are ejected (discharged) from the corresponding nozzle.

During printing, ink droplets are ejected from the print head 19 in process of moving in the main scanning direction together with the carriage 13 onto a sheet of paper that is fed from the cassette 16 and located on the platen 15. In this manner, printing of one line is performed. Thus, printing operation by one scanning of the carriage 13 and paper transport operation to the next line are alternately repeated to thereby proceed with printing on the sheet of paper. In addition, at the left end front face lower portion of the main body 12, various operating switches 20 that include a power switch are provided.

Figure 2:
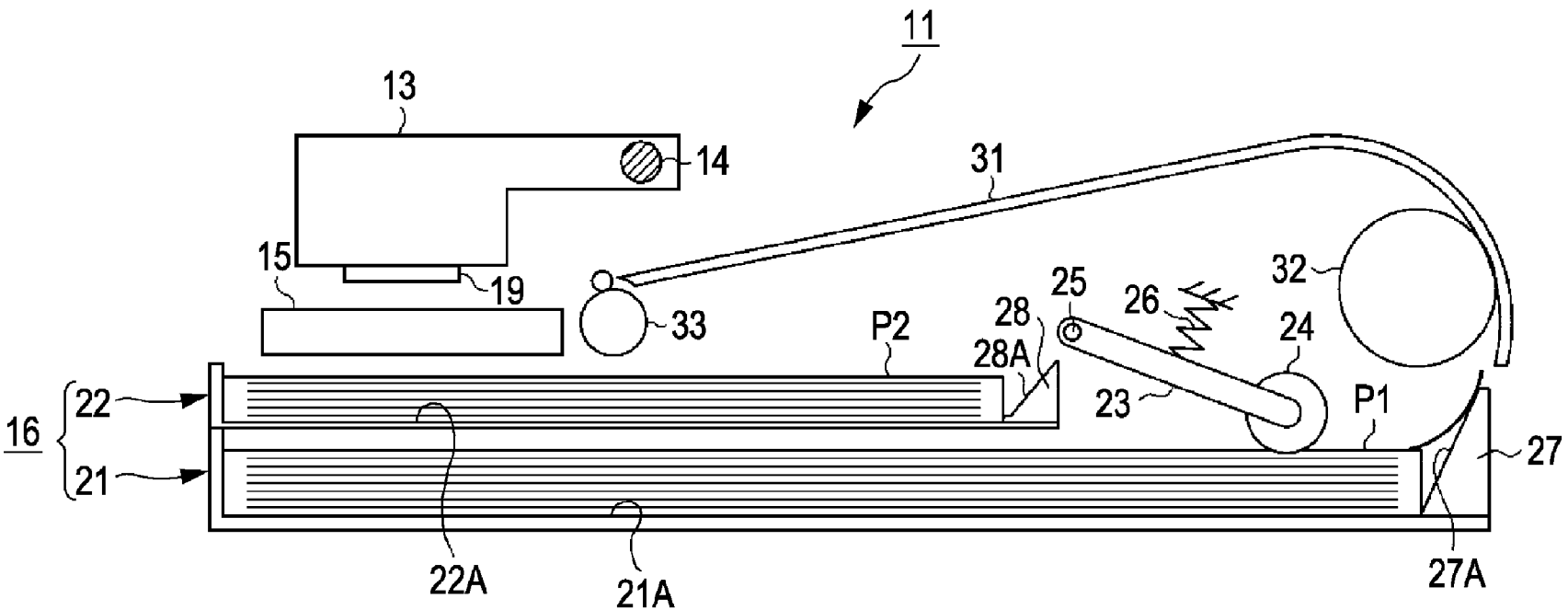
FIG. 2 is a schematic longitudinal cross-sectional view that shows a paper feeding mechanism of the printer.
Figure 3:
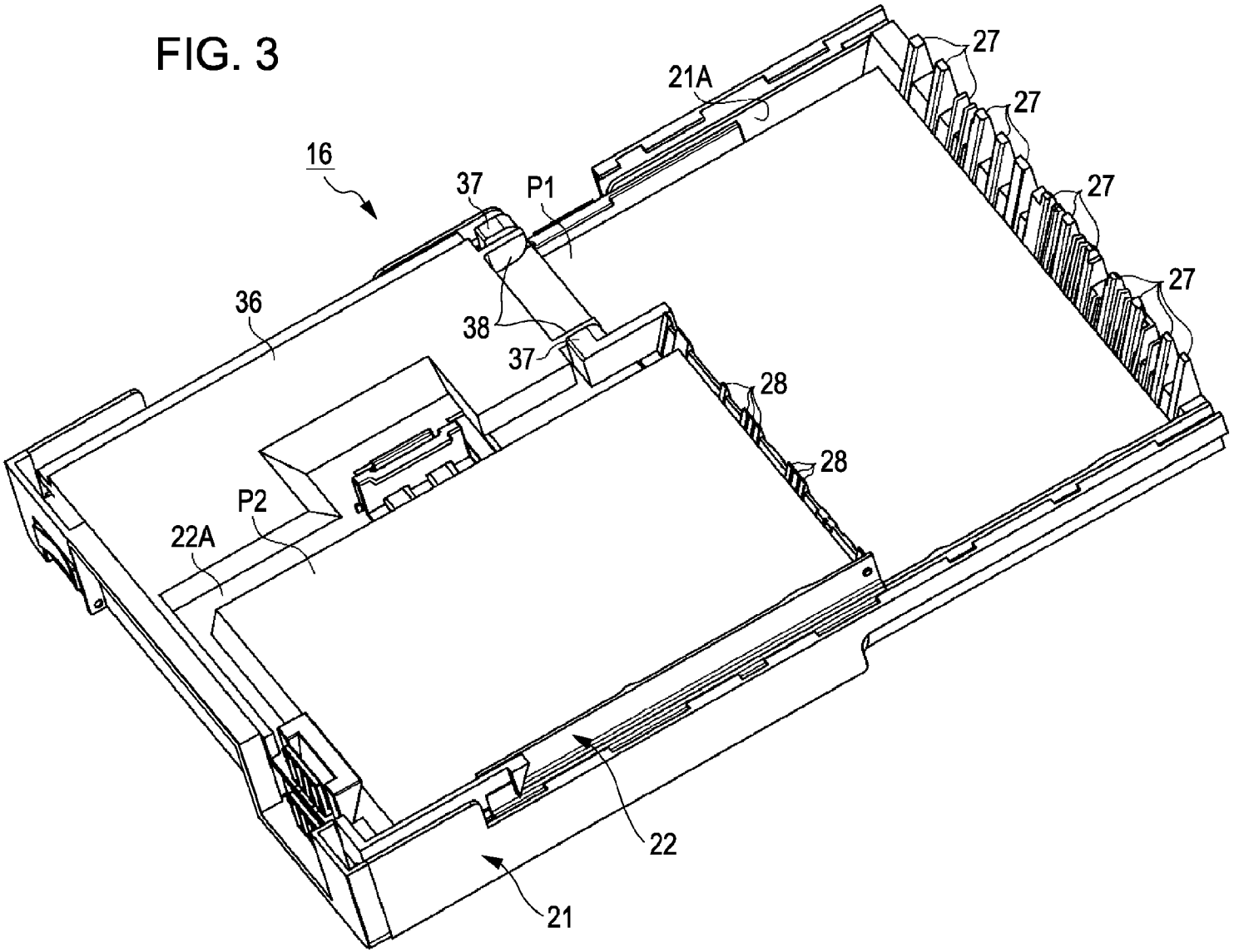
FIG. 3 is a perspective view that shows a cassette in a state where a second tray is located at a retracted position.
Figure 4:
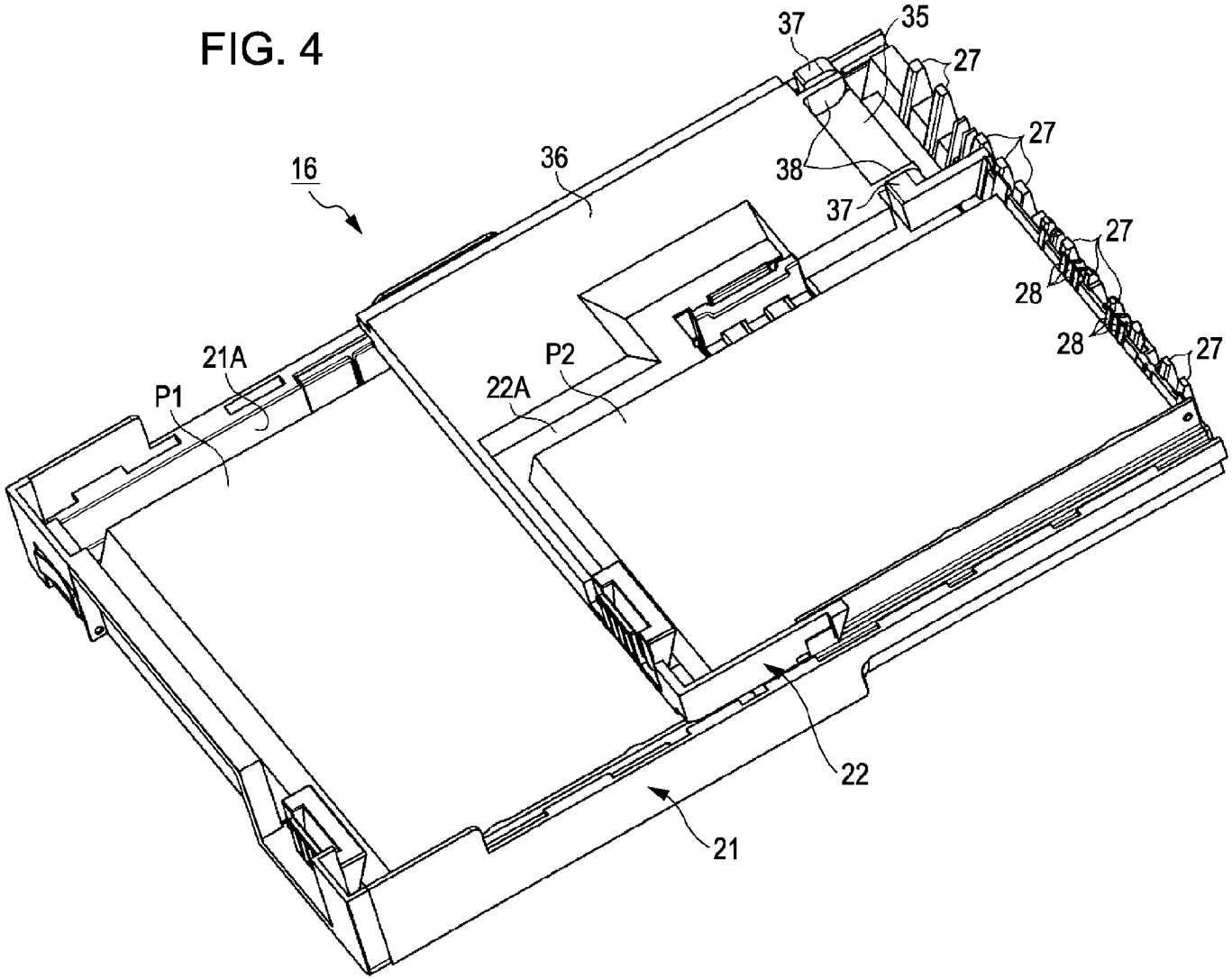
FIG. 4 is a perspective view of the cassette in a state where the second tray is located at a paper feeding position.

FIG. 2 is a longitudinal cross-sectional view of a paper feeding mechanism in a state where the cassette is mounted. In addition, FIG. 3 and FIG. 4 are perspective views of the cassette, respectively. As shown in FIG. 2 to FIG. 4, the cassette 16 includes a first tray 21 and a second tray 22. The first tray 21 is capable of containing large-sized (for example, A4 size) sheet of paper P1. The second tray 22 is capable of containing a small-sized (for example, L size, 2L size, or postcard size) sheet of paper P2. The cassette 16 has a double structure in which the second tray 22 is placed above the first tray 21 (upper side in a paper loading direction) so as to be movable with respect to a cassette insertion/removal direction (lateral direction in FIG. 2).

In the cassette 16 shown in FIG. 2, the second tray 22 is located at a retracted position at which the second tray 22 is retracted to a side (cassette remove direction) opposite to a direction (hereinafter, referred to as cassette insertion direction), in which the cassette 16 is inserted into a mounting portion 12A of the printer 11, with respect to the upper side of the first tray 21. As shown in FIG. 2, a pick-up roller 24 is arranged inside the printer 11 at a position that faces the insertion distal end upper position of the cassette 16 set at the mounting portion 12A and is provided rotatably at the distal end of a lever 23 that is pivotally supported on the main body frame. The lever 23 is urged by a spring 26 in a direction in which the pick-up roller 24 is pressed against the upper face of the sheets of paper P1 (or P2).

At the distal end positions in the cassette insertion direction of the first tray 21 and the second tray 22, a separation portion 27, which serves as a first separation portion, and a separation portion 28, which serves as a second separation portion, that separates only the uppermost sheet of paper from other lower (lower side layer) sheets of paper to be fed among the loaded sheets of paper P1 or P2 respectively extend upward. The separation portion 27 or 28 respectively has an oblique surface 27A or 28A of a predetermined angle at which the distal end of a sheet of paper can abut against the oblique surface 27A or 28A on the way the sheet of paper is delivered from the tray by the pick-up roller 24.

As shown in FIG. 2, when the pick-up roller 24 is driven for rotation in a state where the pick-up roller 24 is in contact with the upper face of the sheet of paper P1 loaded in the containing recess 21A of the first tray 21, the sheet of paper P1 is delivered in a direction (toward the right hand side in FIG. 2) opposite to a paper feeding direction (toward the left hand side in FIG. 2). On the way of this delivery, as the distal end of the sheet of paper P1 abuts against the oblique surface 27A of the separation portion 27, only the uppermost sheet of paper is separated from other sheets of paper and then the separated sheet of paper P1 is guided along the oblique surface 27A upward (delivery direction), and thereafter the uppermost sheet of paper P1 is introduced into an introducing port between a paper feeding guide 31 and a paper feeding roller 32.

The paper feeding guide 31 is formed into a curved plate-like shape at the rear end side (at the right end side in FIG. 2) so as to be able to reverse a sheet of paper to thereby form a feeding path of the sheet of paper. The sheets of paper that is delivered to the rear side from the tray (first tray 21 in FIG. 2) by the rotation of the pick-up roller 24 abut against the oblique surface 27A of the separation portion 27 at the distal ends thereof, so that only the uppermost sheet of paper is separated from the other lower layer sheets of paper. The separated sheet of paper is guided by the oblique surface 27A of the separation portion 27 and introduced into the introducing port located on the upper side, and is further delivered along the paper feeding guide 31 by the rotation of the paper feeding roller 32, so that the sheet of paper is reversed at the curved face portion. After the reversal, the sheet of paper is transported from the rear side toward the front side (toward the left hand side in FIG. 2), and then is nipped (held) between a pair of transport rollers 33. Then, the sheet of paper is transported and fed onto the platen 15 by the rotation of the pair of transport rollers 33. Then, ink droplets are ejected from the print head 19 onto the sheet of paper placed on the platen 15, and printing is thus performed.

On the other hand, a pivot shaft 25, which is a pivot fulcrum of the lever 23, is located at a position higher than a position at which the second tray 22 is arranged. In the process in which the second tray 22 moves from the retracted position shown in FIG. 2 or FIG. 3 to the paper feeding position shown in FIG. 4, when the second tray 22 is arranged at the paper feeding position while pushing aside the lever 23, the pick-up roller 24 runs on the upper face of the sheets of paper P2 loaded on the second tray 22 and is arranged so as to push the upper face of the small-sized sheets of paper P2 loaded on the second tray 22. Thus, when the second tray 22 is arranged at the paper feeding position, the small-sized sheets of paper P2 loaded on the second tray 22 are delivered in the delivery direction by the rotation of the pick-up roller 24. Then, after the distal ends of the delivered sheets of paper P2 abut against the oblique surface 28A of the separation portion 28 and then an uppermost sheet of paper is separated from other sheets of paper (lower layer sheets of paper), the separated sheet of paper is fed by the paper feeding roller 32 along the inner face of the paper feeding guide 31 from the rear side toward the front.

As shown in FIG. 2 to FIG. 4, the first tray 21 has a substantially rectangular box shape that is slightly larger in size than A4 size and that has an opening at its upper side. The first tray 21 has a rectangular containing recess 21A inside as viewed in plan, the containing recess 21A can contain an A4 size sheet of paper P1. The second tray 22 has a width that is substantially equal to that of the first tray 21, and the length thereof in the cassette insertion/removal direction (longitudinal direction) is formed slightly longer than half the overall length in the longitudinal direction of the first tray 21. The second tray 22 is configured to move between the retracted position, shown in FIG. 3, which is a relative position at which the front side face of the second tray 22 aligns with that of the first tray 21, and the paper feeding position, shown in FIG. 4, which is a relative position at which the end face in the cassette insertion direction of the second tray 22 aligns with that of the first tray 21. Thus, within a range in which the second tray 22 moves relative to the first tray 21, the second tray 22 never protrudes from the first tray in the longitudinal direction.

Figure 5:
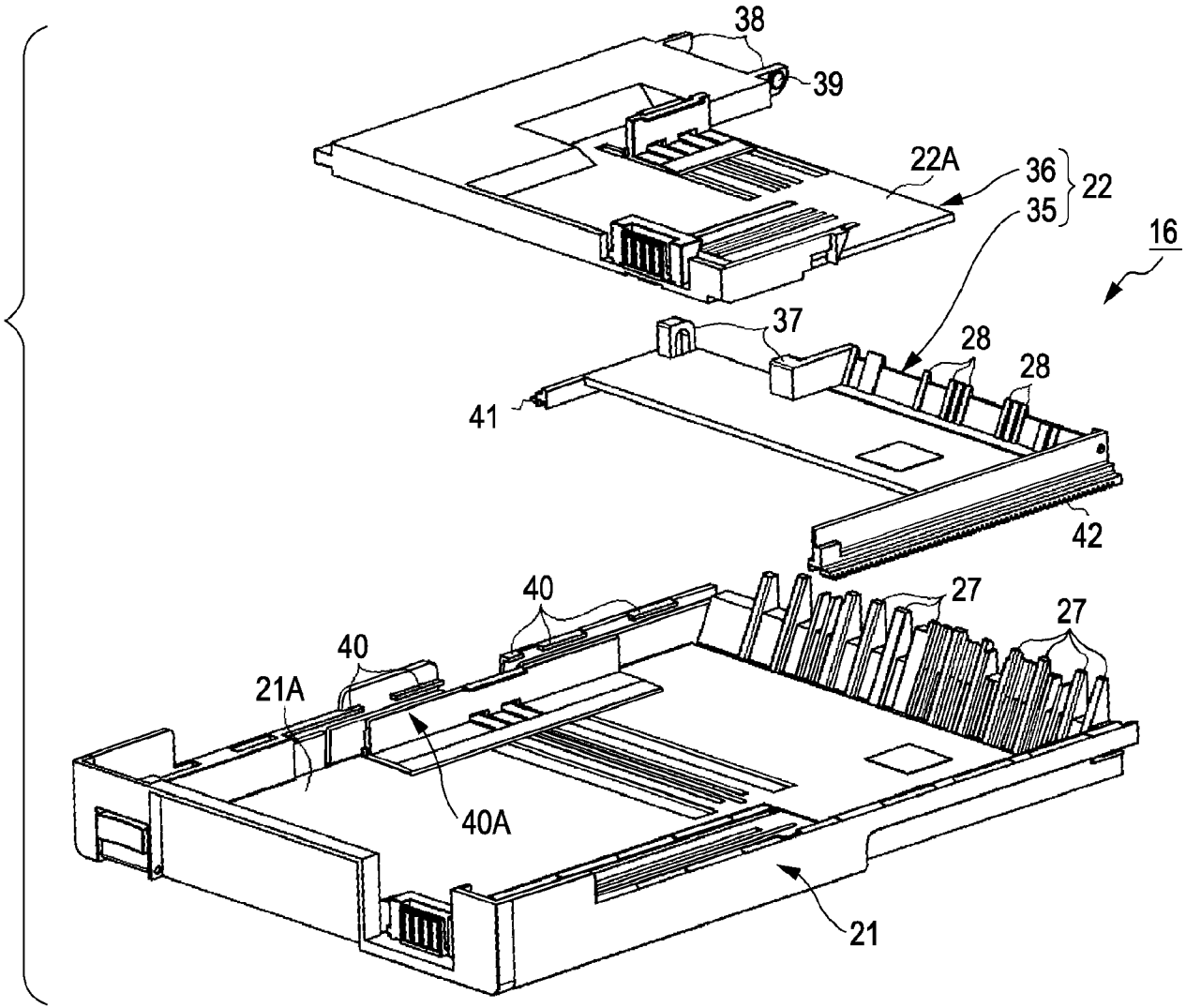
FIG. 5 is an exploded perspective view of the cassette.

FIG. 5 is an exploded perspective view of the cassette. As shown in FIG. 5, the cassette 16 includes the first tray 21 and the second tray 22. Moreover, the second tray 22 includes two components, that is, a support board 35 and a pivot cover 36. The width of each of the support board 35 and the pivot cover 36 (width in a direction that is perpendicular to the cassette insertion/removal direction) is substantially equal to the width of the first tray 21. The support board 35 is fitted to the first tray 21 so as to be slidable in the cassette insertion/removal direction, so that the second tray 22 is movable relative to the first tray 21. A pair of connecting portions 37 that extend from the upper face of the support board 35 at one end portion and shaft portions 39 of a pair of connecting pieces 38 that extend from the end portion of the pivot cover 36 are coupled so as to be pivotable, so that the pivot cover 36 is pivotable so as to open or close vertically about the shaft portions 39 with respect to the support board 35.

Thus, in FIG. 4, when sheets of paper are added in the containing recess 21A of the first tray 21, the area of opening may be ensured widely when the sheets of paper are contained in the first tray 21 by pivoting the pivot cover 36 upward, so that it is easy to add the sheets of paper to the first tray 21. That is, because the cassette 16 has a double structure formed of the first tray 21 and the second tray 22, half the upper side or more of the first tray 21 is covered with the second tray 22; however, the second tray 22 has a pivot structure in which the pivot cover 36 is pivotable, so that it is easy to add the sheets of paper to the first tray 21.

In addition, as shown in FIG. 5, a plurality of guide portions 40 are formed at each side on the inner face upper portion of the first tray 21 so as to extend intermittently along the longitudinal direction, and these plurality of guide portions 40 and the upper end faces of the step portions that face the guide portions 40 at the lower side cooperate to form recessed rail guides 40A (however, only the one on the one side is shown). Then, rail portions 41 (only the one on the left side is shown), formed of a protrusion strip extending substantially vertically outward are formed at both outer side portions of the support board 35. The second tray 22 is configured to be slidable in the cassette insertion/removal direction (lateral direction in FIG. 2) with respect to the first tray 21 in such a manner that the rail portions 41 are engaged with the recessed rail guides 40A. Note that, in the present embodiment, a slide mechanism is formed of the recessed rail guides 40A and the rail portions 41.

In addition, a rack 42 is formed at the right side lower end portion of the support board 35 so as to extend in the cassette insertion/removal direction. The rack 42 constitutes a part of a power transmission mechanism 48 (shown in FIG. 6A to FIG. 7B) that transmits power for moving the second tray 22 relative to the first tray 21.

Figure 6A:
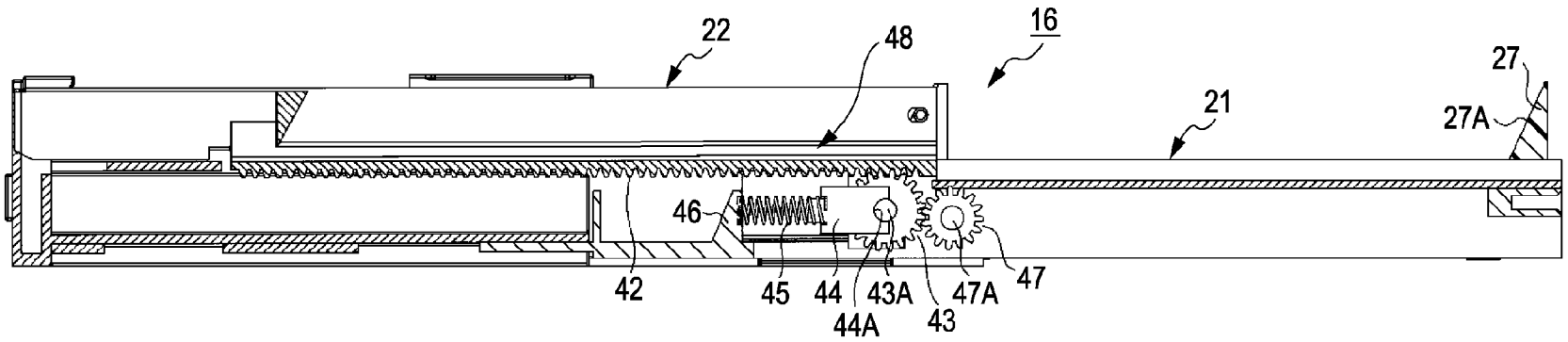
FIG. 6A is a longitudinal cross-sectional view that shows the cassette in a state where the second tray is located at the retracted position.
Figure 6B:
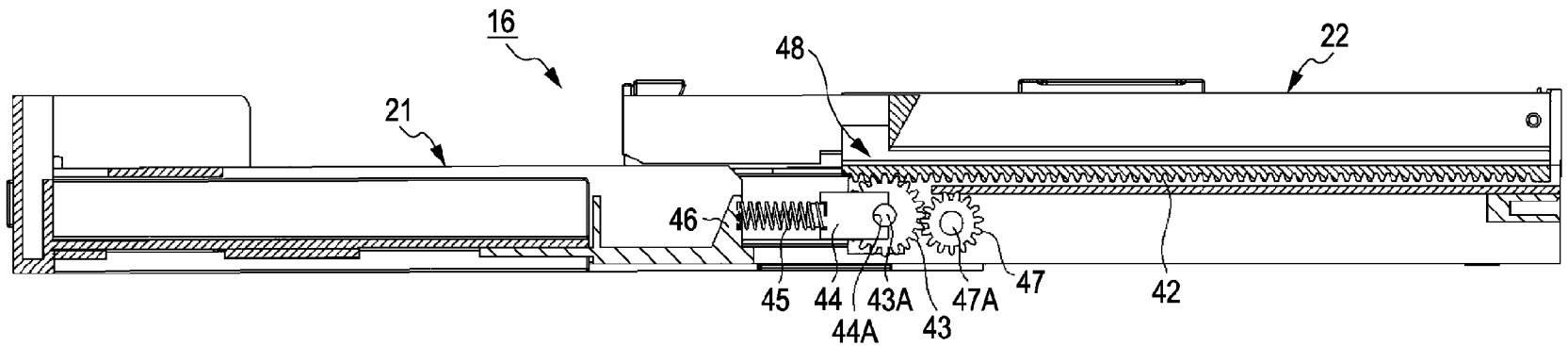
FIG. 6B is a longitudinal cross-sectional view that shows the cassette in a state where the second tray is located at the paper feeding position.
Figure 7A:
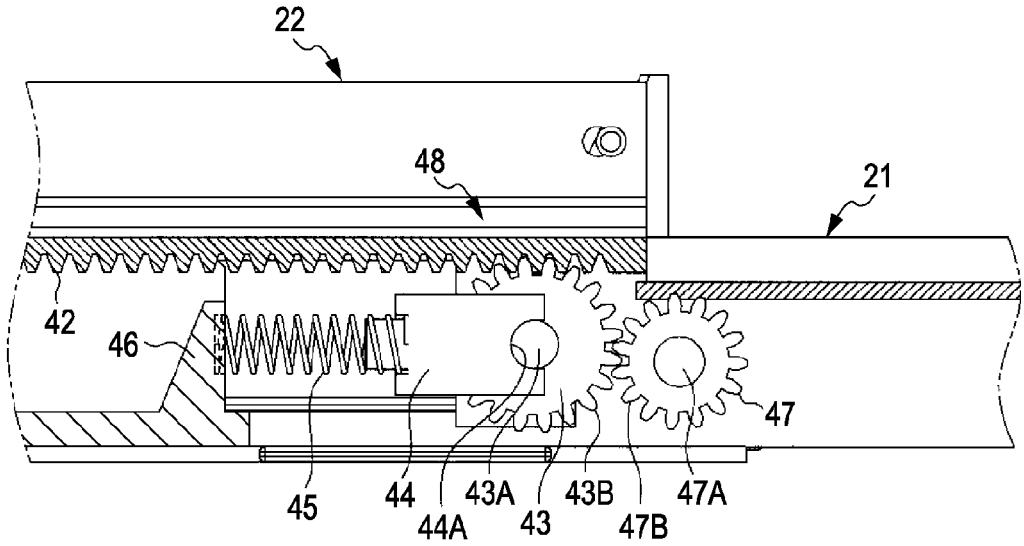
FIG. 7A and FIG. 7B are partially longitudinal cross-sectional views, each of which shows a power transmission mechanism of the cassette.
Figure 7B:
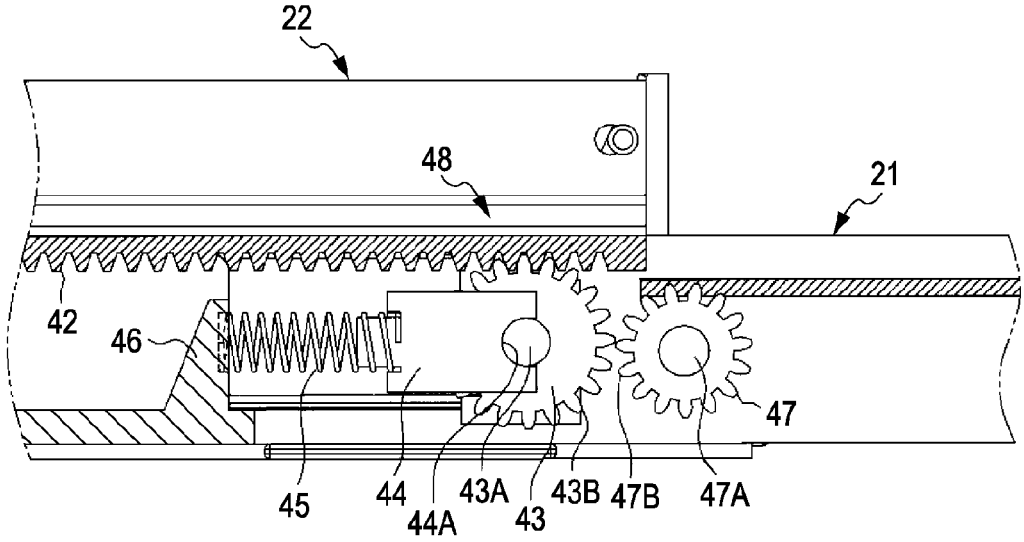

FIG. 6A and FIG. 6B are longitudinal cross-sectional views of the cassette, each of which is shown so that the power transmission mechanism is viewable. FIG. 6A is a view that shows a state in which the second tray is located at the retracted position (first position). FIG. 6B is a view that shows a state in which the second tray is located at the paper feeding position (second position). In addition, FIG. 7A and FIG. 7B are enlarged views, each of which shows the power transmission mechanism.

As shown in FIG. 6A to FIG. 7A, a pinion 43 is supported at one side portion of the first tray 21 and at the substantially center portion in the longitudinal direction thereof so that the pinion 43 can be displaced in the cassette insertion/removal direction with respect to the first tray 21. Specifically, a holder 44 is held at the side portion of the first tray 21 so that it can be displaced in the cassette insertion/removal direction, and a rotary shaft 43A of the pinion 43 is rotatably inserted in a bearing recess 44A that is recessed at the distal end portion of the holder 44 to the cassette insertion direction side.

A compression coil spring 45 is placed in a compressed state between a proximal end portion of the holder 44 (see FIG. 6A to FIG. 7A) and a support portion 46 on the first tray 21 side, and the holder 44 is urged by the elastic force of the compression coil spring 45 in the cassette insertion direction. Thus, the pinion 43 is urged in the cassette insertion direction by the elastic force of the compression coil spring 45 in a state where the pinion 43 is engaged with the rack 42.

The pinion 43 is configured to be engaged with a driving gear 47 that is arranged at a corresponding position in the printer 11 in a state where the cassette 16 is set in the mounting portion 12A. Thus, in the cassette 16, a region to the cassette insertion direction side of the pinion 43 is open as space for arranging the driving gear 47 when the cassette is mounted. Note that, in the present embodiment, the rack 42 and the pinion 43 constitute the power transmission mechanism 48.

The driving gear 47 is coupled through a group of gears (train of gears) (not shown) to a drive shaft of a tray switching motor 49 (shown in FIG. 9), which serves as a power source provided on the printer 11 side so as to be able to transmit power. In a state where the second tray 22 is located at the retracted position shown in FIG. 6A, as the tray switching motor 49 is driven in forward rotation and thereby the driving gear 47 rotates in forward rotation in a counterclockwise direction in the drawing, the pinion 43 rotates in forward direction in a clockwise direction in the drawing, so that the second tray 22 moves from the retracted position shown in FIG. 6A to the paper feeding position shown in FIG. 6B. In addition, in a state where the second tray 22 is located at the paper feeding position shown in FIG. 6B, as the tray switching motor 49 is driven in reverse direction and thereby the driving gear 47 rotates in reverse direction, the pinion 43 rotates in reverse direction, so that the second tray 22 moves from the paper feeding position shown in FIG. 6B to the retracted position shown in FIG. 6A.

As shown in FIG. 7A and FIG. 7B, when the cassette 16 is set in the printer 11, the teeth 43B of the pinion 43 are not always engaged with the teeth 47B of the driving gear 47 but the edges of the teeth 43B and 47B may possibly abut against each other. In this case, if the cassette 16 is pushed in to the end of the stroke, an excessive load is applied between the abutted teeth 43B and 47B and, therefore, the teeth 43B and 47B may possibly be broken. However, in the present embodiment, the pinion 43 is supported so that it can be displaced in the cassette insertion/removal direction (lateral direction in FIG. 7A and FIG. 7B) and is urged by the urging force of the compression coil spring 45 in the cassette insertion direction (toward the right hand side in FIG. 7A and FIG. 7B). Thus, when the cassette is mounted, as shown in FIG. 7B, even when the edge of the teeth 43B of the pinion 43 abut against the edge of the teeth 47B of the driving gear 47, because the pinion 43 retracts in a direction opposite to the cassette insertion direction against the urging force of the compression coil spring 45, an excessive load is avoided from being applied between the abutted teeth 43B and 47B. Then, after the cassette 16 is mounted, as at least one of the pinion 43 or the driving gear 47 slightly rotates, both the teeth 43B and 47B are engaged with each other by the urging force of the compression coil spring 45 as shown in FIG. 7A.

In addition, even when a user removes the cassette 16 during rotation of the driving gear 47, because the pinion 43 retracts against the urging force of the compression coil spring 45, an excessive load is avoided from being applied between the teeth 43B of the pinion 43 and the teeth 47B of the driving gear 47 when the cassette 16 is removed.

Figure 8:
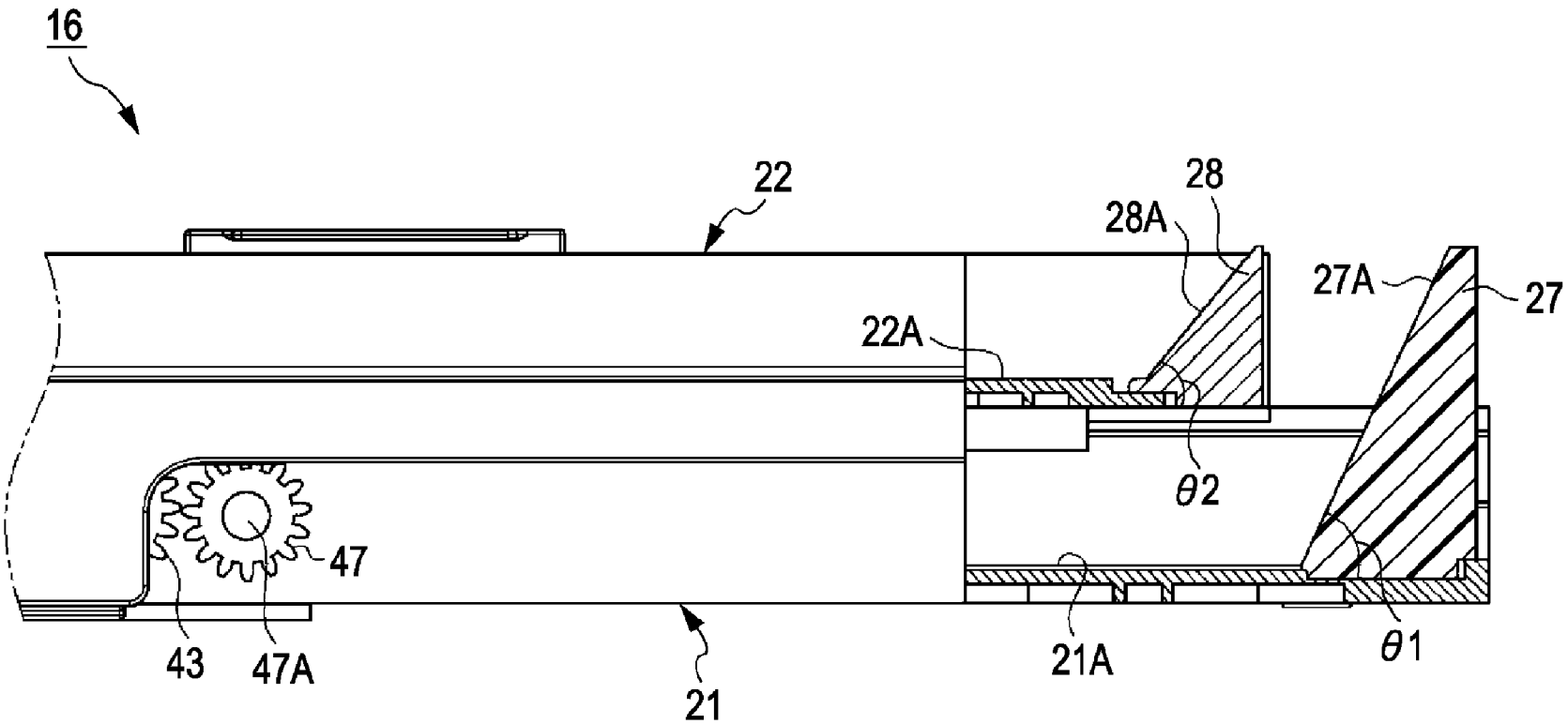
FIG. 8 is a partially longitudinal cross-sectional view of the cassette, which shows a separation portion provided for each tray.

FIG. 8 is a longitudinal cross-sectional view of a relevant part of the cassette with partially cut away. As shown in FIG. 8, in the present embodiment, the angle of inclination θ1 of the oblique surface 27A of the separation portion 27 that extends from the distal end portion to the cassette insertion direction side of the first tray 21 is different from the angle of inclination θ2 of the oblique surface 28A of the separation portion 28 that extends from the distal end portion to the cassette insertion direction side of the second tray 22. In the present embodiment, large-sized (A4 size in this embodiment) "plain paper" is assumed as a sheet of paper contained in the containing recess 21A of the first tray 21. On the other hand, small-sized "photo paper" (L size or 2L size) or "postcard" is assumed as a sheet of paper contained in the containing recess 22A of the second tray 22.

Here, when the distal ends of sheets of paper delivered by the pick-up roller 24 abut against the oblique surface 27A or 28A, the separation portion 27 or 28 has a separation function for separating the uppermost sheet of paper from other lower side sheets of paper and a guide face function for guiding upward the separated uppermost sheet of paper along the oblique surface 27A or 28A toward an introducing portion between the paper feeding roller 32 and the paper feeding guide 31.

In the case when the paper is the sheet of paper P1 that is relatively thin and flexible as in the case of "plain paper", if the angle of inclination of the oblique surface 27A (angle gradient of the oblique surface) is relatively small, even when the distal ends of the sheets of paper P1 abut against the oblique surface 27A, the uppermost sheet of paper is hard to be separated from other lower side sheets of paper. Then, even when the angle of inclination of the oblique surface 27A is made relatively large for easy separation, the separated uppermost sheet of paper bends and, therefore, is easily guided toward the introducing port along the oblique surface 27A. Thus, in regard to the first tray 21 for which sheets of paper, such as relatively flexible "plain paper", are used, the angle of inclination θ1 of the oblique surface 27A of the separation portion 27 is set for a relatively large angle.

On the other hand, in the case of the sheet of paper P2, which is relatively thick and hard as in the case of "photo paper" or "postcard", because it is easy to be separated, it can be separated even when the angle of inclination of the oblique surface 28A against which the distal end of the sheets of paper P2 abut is not set for a relatively large angle. However, when the angle of inclination of the oblique surface 28A is made excessively large, there is a possibility that the separated uppermost sheet of paper cannot be bent along the oblique surface 28A and, therefore, cannot be guided. Thus, the angle of inclination θ2 of the oblique surface 28A of the separation portion 28 of the second tray 22 for which the sheets of paper P2, such as relatively hard "photo paper" or "postcard", are used is set relatively smaller than the angle of inclination θ1 of the oblique surface 27A of the separation portion 27 of the first tray 21 for which the sheets of paper P1, such as relatively soft "plain paper", are used (θ1>θ2).

In addition, in the present embodiment, in consideration of the above points, the separation portions 27 and 28 employ different materials between the first tray 21 and the second tray 22. For example, the separation portion 28 of the second tray 22 for which hard sheets of paper P2 are used employs a material that tends to form a face having a relatively small coefficient of friction as compared with the separation portion 27 of the first tray 21 for which flexible sheets of paper P1 are used. An example of the material may be a polyacetal (POM) resin for the separation portion 28 of the second tray 22 for which hard sheets of paper P2 are used and an ABS resin for the separation portion 27 of the first tray 21 for which flexible sheets of paper P1 are used. Furthermore, at least the oblique surface 28A of the separation portion 28 is mirror-polished in order to reduce the coefficient of friction of the oblique surface 28A. Note that, in the present embodiment, an oblique surface structure that is different between a first separation portion and a second separation portion corresponds to the angle of inclination and the coefficient of friction of the oblique surface. Of course, it is sufficient that at least one of the angle of inclination and the coefficient of friction is different.

In addition, the length in which the separation portion 27 provided for the lower first tray 21 protrudes is relatively long, and the length in which the separation portion 28 provided for the upper second tray 22 protrudes is relatively short. Then, when the cassette 16 is mounted, the upper end positions of the two separation portions 27 and 28 are at substantially the same height to an extent that the separation portions 27 and 28 do not interfere with the introducing port side lower end of the paper feeding guide 31, shown in FIG. 2. Thus, the separation portion 27 when the first tray 21 is selected as a paper feeding tray (state shown in FIG. 3 or FIG. 6A) and the separation portion 28 when the second tray 22 is selected as a paper feeding tray (see FIG. 4 or FIG. 6B) each are located so that the upper end position is located near the introducing port side lower end of the paper feeding guide 31, so that the sheet of paper P1 or P2 separated by the separation portion 27 or 28 may be smoothly guided along the oblique surface 27A or 28A toward the introducing port. Note that the relative position between the first tray and the second tray when the second tray 22 is located at the retracted position corresponds to "first position", while, on the other hand, the relative position between the first tray and the second tray when the second tray 22 is located at the paper feeding position corresponds to "second position".

Figure 9:
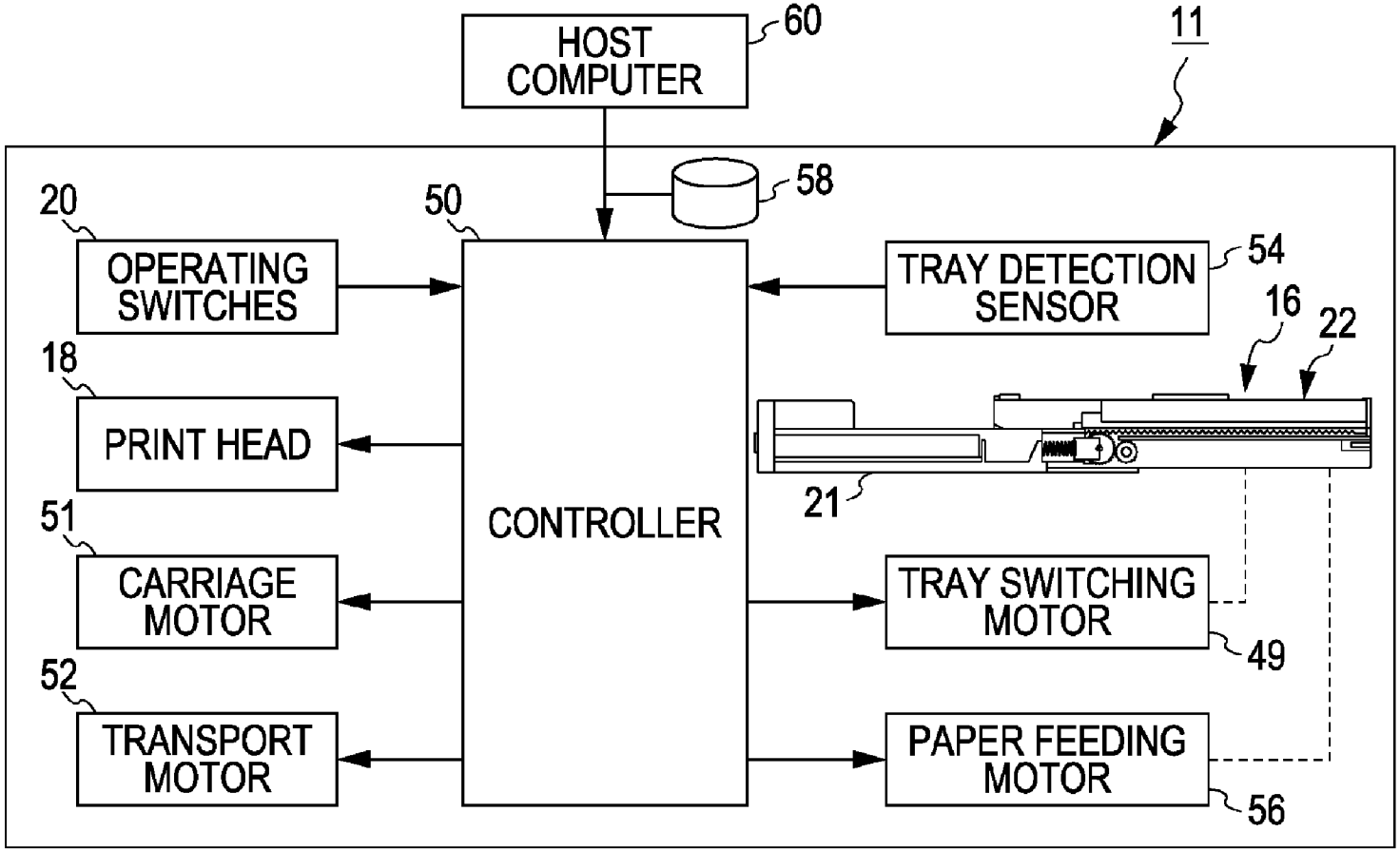
FIG. 9 is a block diagram that shows the electrical configuration of the printer.

FIG. 9 is a block diagram that shows the electrical configuration of the printer. The printer 11 is connected communicable with a host computer 60, such as a personal computer (PC), for example, and is used. The printer 11 internally includes a controller 50 that centrally controls the printer 11. The controller 50 internally includes, for example, a CPU, an ASIC (Application Specific IC), a ROM, a RAM, a flush memory (for example, EEPROM), and the like, and performs control of paper feeding operation, printing operation, paper transport operation, and the like, in the printer 11 in such a manner that the CPU executes a program that is read from the ROM or the flush memory. The operating switches 20, the print head 19, a carriage motor 51, a transport motor 52, a tray detection sensor 54, the tray switching motor 49 and a paper feed motor 56 are electrically connected to the controller 50.

The controller 50 has a buffer 58 that temporarily stores print data received from the host computer 60. The controller 50 separates the print data received from the buffer 58 into a command and bitmap data and controls the print head 19 on the basis of the bitmap data to perform print operation. In addition, the controller 50, in accordance with the command, controls driving of the carriage motor 51 and the transport motor 52 to thereby control printing operation and paper transport operation. The controller 50, when performs paper feeding operation, drives the paper feed motor 56 and, by the driving of the paper feed motor, the pick-up roller 24 and the paper feeding roller 32 are driven for rotation in a direction in which sheets of paper can be delivered. Note that power from the paper feed motor 56 is transmitted to the pick-up roller 24 through a train of gears provided at the side portion of the lever 23.

Here, print data that are initially received by the printer 11 include information regarding paper type and paper size that are input by a user using an input device (a keyboard, a mouse, or the like) of the host computer 60. The controller 50 recognizes a paper feeding tray (feeding tray) that should be used for feeding sheets of paper from among the first tray 21 and the second tray 22 in the cassette 16 on the basis of the information regarding the paper type and the paper size.

The tray detection sensor 54 is a sensor that detects whether the second tray 22 is located at the retracted position shown in FIG. 3 or FIG. 6A or at the paper feeding position shown in FIG. 4 or FIG. 6B. The tray detection sensor 54 outputs a detection signal in accordance with each position. The controller 50 recognizes that the paper feeding tray is the first tray 21 on the basis of the detection signal when the second tray 22 is located at the retracted position or recognizes that the paper feeding tray is the second tray 22 on the basis of the detection signal when the second tray 22 is located at the paper feeding position. Then, the controller 50 determines whether the currently selected paper feeding tray coincides with the paper feeding tray determined on the basis of a sheet of paper specified. When the currently selected paper feeding tray does not coincide with the determined paper feeding tray, a tray switching process is performed so as to select the tray according to the specified sheet of paper as the paper feeding tray.

Figure 10:
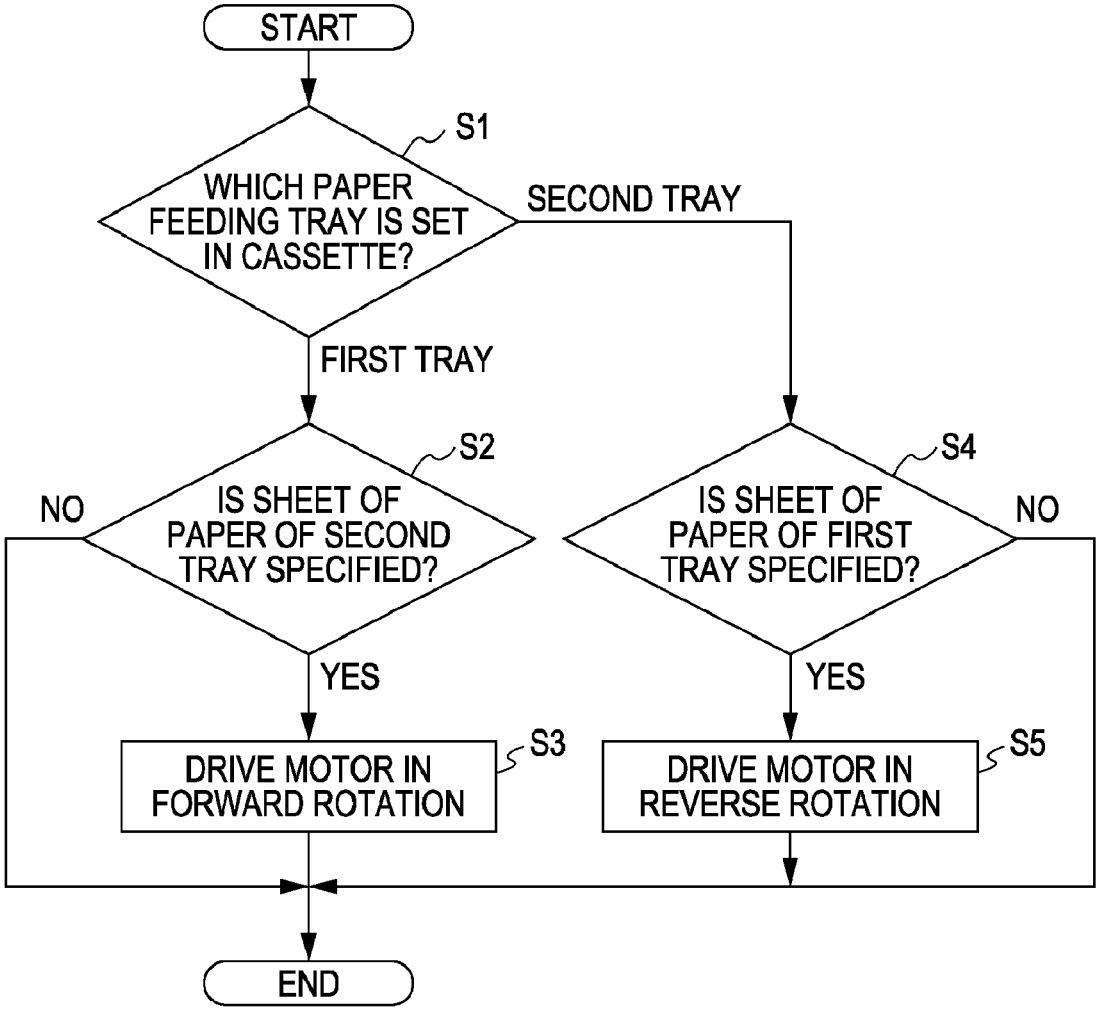
FIG. 10 is a flowchart that shows a tray switching process.

This tray switching process is performed in such a manner that the CPU in the controller 50 executes a program shown in the flowchart of FIG. 10. Hereinafter, the tray switching process will be described. As the CPU receives print data, at first, in step S1, it is determined which of the first tray 21 and the second tray 22 is the current paper feeding tray in the cassette 16. When the paper feeding tray is the first tray 21, the process proceeds to step S2, and then it is determined whether the sheet of paper of the first tray 21 is specified. For example, when the specified sheet of paper is paper type "photo paper" and paper size "L size", it is determined that the sheet of paper of the second tray 22 is selected. When the sheet of paper of the second tray 22 is specified, the process proceeds to step S3 and then the tray switching motor 49 is driven in forward rotation. As a result, the rotary force of the driving gear 47 is input to the pinion 43 and the pinion 43 is then rotated in forward direction. Thus, by the power transmitted through the rack 42, the second tray 22 moves from the retracted position to the paper feeding position and then the paper feeding tray is switched from the first tray 21 to the second tray 22. On the other hand, when the sheet of paper of the second tray 22 is not specified, the routine ends. That is, the state in which the paper feeding tray is the first tray 21 is maintained.

When the paper feeding tray is the first tray 21, as shown in FIG. 2, the pick-up roller 24 contacts on the upper face of the sheets of paper P1 on the first tray 21. Then, when the paper feed motor 56 is driven, the pick-up roller 24 and the paper feeding roller 32 are rotated, so that the uppermost sheet among the sheets of paper P1 is fed. At this time, the flexible sheets of paper P1 that have been fed by the pick-up roller 24 abut against the oblique surface 27A of the separation portion 27, which has a relatively large angle of inclination θ1, at their distal ends, so that the uppermost sheet of paper is reliably separated and is smoothly guided toward the introducing port between the paper feeding roller 32 and the paper feeding guide 31.

On the other hand, in step S1, when it is determined that the paper feeding tray is the second tray 22, in step S4, it is determined whether the sheet of paper of the first tray 21 is specified. For example, when the specified sheet of paper is paper type "plain paper" and paper size "A4 size", it is determined that the sheet of paper of the first tray 21 is selected. When the sheet of paper of the first tray 21 is specified, the process proceeds to step S5 and then the tray switching motor 49 is driven in reverse rotation. As a result, the rotary force of the driving gear 47 is input to the pinion 43 and the pinion 43 is then rotated in reverse direction. Thus, by the power transmitted through the rack 42, the second tray 22 moves from the paper feeding position to the retracted position and then the paper feeding tray is switched from the second tray 22 to the first tray 21. On the other hand, when the sheet of paper of the first tray 21 is not specified, the routine ends. That is, the state in which the paper feeding tray is the second tray 22 is maintained.

When the paper feeding tray is the second tray 22, as shown in FIG. 4 and FIG. 6B, the pick-up roller 24 contacts on the upper face of the sheets of paper P2 on the second tray 22. Then, when the paper feed motor 56 is driven, the pick-up roller 24 and the paper feeding roller 32 are rotated, so that the uppermost sheet among the sheets of paper P2 is fed. At this time, the hard sheets of paper P2 that have been fed by the pick-up roller 24 abut against the oblique surface 28A of the separation portion 28, which has a relatively small angle of inclination θ2, at their distal ends, so that the uppermost sheet of paper is reliably separated and is smoothly guided toward the introducing port between the paper feeding roller 32 and the paper feeding guide 31.

As described in detail above, according to the present embodiment, the following advantageous effects are obtained. (1) When the cassette 16 is set in the mounting portion 12A of the printer 11, the power from the tray switching motor 49 provided on the main body 12 side is input from the driving gear 47 to the pinion 43 and then the power input through the pinion 43 to the power transmission mechanism 48 on the cassette 16 side moves the first tray 21 and the second tray 22 relative to each other. In this manner, in the cassette 16, the feeding tray is automatically switched between the first tray 21 and the second tray 22. Thus, it is not necessary to manually perform tray switching operation. In addition, because the cassette 16 does not need to have a power source, such as a tray switching motor, the cassette 16 may have a relatively simple configuration.

(2) Because the power transmission mechanism 48 that moves the first tray 21 and the second tray 22 relative to each other employs a rack and pinion mechanism formed of the rack 42 and the pinion 43, it is possible to avoid an increase in size of the cassette 16 as much as possible while achieving automatic switching of a tray.

(3) Because, in the cassette 16, a region to the cassette insertion direction side of the pinion 43 is open, when the cassette 16 is mounted on the printer 11, it is possible to engage the pinion 43 and the driving gear 47 in such a manner that the driving gear 47 on the main body 12 side is arranged in the open space to the cassette insertion direction side of the pinion 43. Thus, when a user only performs a normal operation that the cassette 16 is inserted into the mounting portion 12A, the pinion 43 may be engaged with the driving gear 47. Hence, it is not accompanied by an extra operation for connecting the power transmission mechanism 48 on the cassette 16 with the tray switching motor 49 on the main body 12 so as to be able to transmit power.

(4) The pinion 43 is provided so that it can be displaced in the cassette insertion/removal direction with respect to the first tray 21 and is urged by the elastic force of the compression coil spring 45, which serves as an urging device, in the cassette insertion direction. Thus, when the cassette 16 is mounted on the printer 11, even when the cassette 16 is pushed in to the end in a state where the teeth 43B of the pinion 43 are not engaged with the teeth 47B of the driving gear 47 but abut against the teeth 47B (state shown in FIG. 7B), the pinion 43 displaces in a direction opposite to the cassette insertion direction against the urging force of the compression coil spring 45. As a result, it is possible to avoid a large load from being applied between the teeth 43B of the pinion 43 and the teeth 47B of the driving gear 47, and it is possible to prevent breakage, or the like, of the teeth 43B and 47B. Then, when at least one of the pinion 43 or the driving gear 47 slightly rotates, because the pinion 43 is urged by the compression coil spring 45, it is possible to reliably engage the teeth 43*b* of the pinion 43 and the teeth 47B of the driving gear 47.

(5) The angle of inclination θ2 of the oblique surface 28A of the separation portion 28 provided for the second tray 22 in which relatively small-sized, thick and hard sheets of paper P2 are contained is set smaller than the angle of inclination θ1 of the oblique surface 27A of the separation portion 27 provided for the first tray 21 in which large-sized, thin and flexible sheets of paper P1 are contained. Thus, when the first tray 21 is selected as the paper feeding tray, flexible sheets of paper P1, such as A4 size plain paper, contained in the first tray 21 may be reliably separated by the oblique surface 27A of the separation portion 27, and the separated sheet of paper may be smoothly guided along the oblique surface 27A upward to the introducing port on the paper feeding roller 32 side. On the other hand, when the second tray 22 is selected as the paper feeding tray, relatively hard sheets of paper P2, such as photo paper or postcard, contained in the second tray 22 may be reliably separated by the oblique surface 28A of the separation portion 28, and the separated sheet of paper may be smoothly guided along the oblique surface 28A upward to the introducing portion on the paper feeding roller 32 side.

(6) Because the second tray 22, which is smaller than the first tray 21, moves relatively above the first tray 21, it is possible to eliminate an amount by which the second tray 22 protrudes with respect to the first tray 21 in position at which the second tray 22 is maximally moved relative to the first tray 21. Thus, the space for accommodating the cassette in the printer 11 may be relatively narrow and, hence, it contributes to a decrease in size of the printer 11.

Note that it is not limited to the above embodiment, but it may be modified into the following configurations.

First Alternative Embodiment

It is also applicable that the direction in which the first tray and the second tray are able to move relative to each other is a direction that intersects with the cassette insertion/removal direction. In short, it is sufficient when relative movement that switches between a state in which a medium may be delivered by the pick-up roller 24 and a state in which the medium is not delivered is possible.

Second Alternative Embodiment

The cassette may be configured to be further provided with a third tray in addition to the first tray and the second tray. In this case, the first to third trays may be arranged triple or the second tray and the third tray both may be arrange at the second step. Even when two trays are arranged at the same step, it is possible to employ an appropriate configuration that is able to switch trays so as to switch a medium on which the pick-up roller 24 contacts. For example, directions in which two trays arranged at the same step move may be configured to be perpendicular to each other. That is, above the tray at the first step, one tray moves relatively in the cassette insertion/removal direction and the other tray moves relatively in a direction perpendicular to the cassette insertion/removal direction (widthwise direction). Of course, the cassette is not limited to the three tray configuration but it may also employ four or more tray configuration.

For example, when three or more trays are employed, the rack and pinion mechanism is provided each between the trays, and a plurality of driving gears corresponding to the pinions are provided on the main body side. In addition, it is applicable that a clutch device that is able to selectively switch a pinion to which power is input among a plurality of pinions is provided and the pinion to which power from the driving gear is input is selected by switching of the clutch device. Furthermore, it may employ a power transmission mechanism in which a driven gear on the cassette side, which engages the driving gear, is only one and, by driving the driven gear, the feeding tray is switched in the order of the first tray, the second tray, the third tray, . . . . For example, by interposing a reduction gear mechanism between the trays, a moving speed is varied among the trays. Thus, sheets of paper on the tray reach a position at which the sheets of paper on the tray contact the pick-up roller in the order of the first tray, the second tray, the third tray, . . . . Note that the orientation in which the cassette is mounted is not limited to the horizontal, but the cassette may be, for example, mounted vertically.

Third Alternative Embodiment

In the present embodiment, the controller 50 determines the specified sheet of paper and performs control to switch the relative position of the trays so that the tray corresponding to the determined sheet of paper is selected as the paper feeding tray; however, for example, it is also applicable that the tray switching motor is driven in such a manner that a user operates a switch provided on the main body of the printer to thereby switch the paper feeding tray.

Fourth Alternative Embodiment

The plurality of trays provided for the cassette are a combination of the first tray, which is a large-sized tray that contains large-sized sheets of paper, and the second tray, which is a small-sized tray that contains small-sized sheets of paper; however, for example, a combination of trays, each of which contains the same size sheets of paper, may also be employed. In this case, sheets of paper of different types may be contained; however, it may be configured so that sheets of paper of the same types are contained and, when sheets of paper in one of the trays are empty, sheets of paper in the other tray are used.

Fifth Alternative Embodiment

The power source is not limited to a motor exclusive to the cassette, such as the tray switching motor 49. For example, another motor, such as the paper feed motor 56, the carriage motor 51 or the transport motor 52, may double as a power source for driving a tray in the cassette 16.

Sixth Alternative Embodiment

The power transmission mechanism is not limited to the mechanism that is provided with the rack and the pinion. For example, a power transmission mechanism that is provided with a roller, a pulley or a sprocket, which loops a belt, a wire or a chain, to move a tray in a belt system, a wire system or a chain system may be employed. That is, as the roller, the pulley or the sprocket that loops the belt, the wire or the chain is driven for rotation by the power input from the driving gear to the power transmission mechanism, the first tray and the second tray move relative to each other by means of the belt system, the wire system or the chain system.

Seventh Alternative Embodiment

In the present embodiment, the power source is provided on the main body side of the image forming apparatus body side; however, it is applicable that the power source is provided on the cassette side. In this case, a connector is provided on the cassette and is electrically connected to a connector of the main body side by mounting the cassette, and, for example, it is also applicable that the power source (tray switching motor) on the cassette is controlled for driving by the controller on the main body side.

Eighth Alternative Embodiment

The image forming apparatus is not limited to an ink jet printer (liquid ejecting apparatus), but it may be, for example, a dot-impact printer, a laser printer, a thermal imprint recording printer, or the like. In addition, the image forming apparatus is not limited to a serial printer, but it may be applied to a line printer. Furthermore, the image forming apparatus is not limited to a printer, but it may be a scanner. That is, the aspects of the invention may be applied to a cassette used for a scanner. In the case of the scanner, the process in which an image of an original is read and then data of the image are generated corresponds to image forming.

Hereinafter, technical ideas that are understood from the above embodiment and the above alternative embodiments will be described.

(1) In the cassette according to the aspect of the invention, the image forming apparatus may be provided with a pick-up roller, wherein, when the cassette is mounted on a image forming apparatus body, the first tray and the second tray may move relative to each other between a first position at which media on the first tray contacts the pick-up roller and a second position at which media on the second tray contacts the pick-up roller.

(2) In the cassette according to the aspect of the invention and the above technical idea (1), the first tray and the second tray may be arranged double in a direction in which media are loaded, wherein the second tray may be provided so as to be movable relative to the first tray.

(3) In the cassette according to the aspect of the invention, the pinion may provided so that it can be displaced at least in a cassette insertion direction in which the cassette is inserted, wherein the cassette may further include an urging device that urges the pinion in the cassette insertion direction.

(4) In the cassette according to the aspect of the invention, the power transmission mechanism may include an input gear that inputs power, wherein the input gear may be engaged with a driving gear on the image forming apparatus body side when the cassette is mounted on the image forming apparatus body.

(5) In the cassette according to the aspect of the invention, the first tray and the second tray may be movable relative to each other in the cassette insertion/removal direction.

(6) In the cassette according to the aspect of the invention, wherein the second tray may have a pivot cover that is pivotable so that the second tray partially opens a portion thereof, which covers the first tray.

(7) The image forming apparatus according to the aspect of the invention may further include a control device that controls to drive the power source so that it is determined what medium size is specified on the basis of image forming instruction information received and, when it is determined that, between the first tray and the second tray, a tray that is selected as a paper feeding tray to feed a medium is not a tray corresponding to the specified medium size, a relative position between the first tray and the second tray may be switched between the first position and the second position to a position at which the tray corresponding to the specified medium size is selected as the paper feeding tray.

What is claimed is:

1. An image forming apparatus including a mountable cassette which supplies media to the image forming apparatus, the image forming apparatus comprising:

a mountable cassette which supplies media to the image forming apparatus, the mountable cassette including:

a first tray that is able to contain multiple media;

a second tray that is able to contain multiple media; and a slide mechanism that allows the first tray and the second tray to be movable relative to each other, wherein the first tray has an oblique surface and a first separation portion, and the second tray has an oblique surface and a second separation portion, wherein each of the oblique surfaces can separate an uppermost medium from other media in such a manner that distal ends of the media during delivery abut against the oblique surface, wherein each of the first and second separation portions guides the separated medium along the oblique surface in a paper feeding direction, and wherein the first separation portion provided for the first tray is different in structure of the oblique surface from the second separation portion provided for the second tray, wherein an uppermost edge of the second oblique surface is at substantially the same level as an uppermost edge of the first oblique surface;

a mounting portion on which the mountable cassette is mounted; and a pick-up roller that is driven so as to be able to deliver media on the cassette that is mounted on the mounting portion, wherein when the cassette is mounted in the mounting portion, the first tray and the second tray are movable relative to each other so that the second tray is movable over the first tray, the second tray moving between a first position at which the pick- up roller contacts an uppermost medium among media loaded on the first tray and a second position where the second oblique surface of the second tray overlaps the first oblique surface of the first tray such that the pick-up roller contacts an uppermost medium among media loaded on the second tray, and wherein a tray from which the pick-up roller delivers media is switched in such a manner that a relative position between the first tray and the second tray is switched between the first position and the second position.

2. The image forming apparatus according to claim 1, wherein the oblique surface of the first separation portion and the oblique surface of the second separation portion have different angles of inclination.

3. The image forming apparatus according to according to claim 2, wherein the second oblique surface has a sharper angle of inclination than the first oblique surface, and the coefficient of friction of the second oblique surface is smaller than that of the first oblique surface.

4. The image forming apparatus according to claim 1, wherein the oblique surface of the first separation portion and the oblique surface of the second separation portion have different coefficients of friction.

5. The image forming apparatus according to claim 1, wherein the second tray is a small-sized tray of which the size of a containable medium is smaller that that of the first tray, and wherein an angle of inclination of the oblique surface of the second separation portion is set smaller than an angle of inclination of the oblique surface of the first separation portion.

6. The image forming apparatus according to claim 1, wherein the second tray is a tray that contains media that are harder than media contained in the first tray, and wherein an angle of inclination of the oblique surface of the second separation portion is set smaller than an angle of inclination of the oblique surface of the first separation portion.

7. The image forming apparatus according to claim 1, further comprising:

a power transmission mechanism that contacts or leaves a power output portion provided for the image forming apparatus body in accordance with insertion or removal of the cassette to or from the image forming apparatus body, wherein the power transmission mechanism, when the cassette is mounted, moves the first tray and the second tray relative to each other by power input from the power output portion.

* * * * *